US012584199B2

(12) United States Patent
Kumar et al.

(10) Patent No.: US 12,584,199 B2
(45) Date of Patent: Mar. 24, 2026

(54) DRILL BIT COMPACT AND METHOD INCLUDING GRAPHENE

(71) Applicant: NATIONAL OILWELL VARCO, L.P., Houston, TX (US)

(72) Inventors: Biju P. Kumar, Houston, TX (US); Richard Rivera, Jr., Conroe, TX (US); Tom Scott Roberts, Montgomery, TX (US); Brad Ivie, Hamilton, MT (US); Richard Jordan, Gloucestershire (GB)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 0 days.

(21) Appl. No.: 17/906,235

(22) PCT Filed: Mar. 12, 2021

(86) PCT No.: PCT/US2021/022076
§ 371 (c)(1),
(2) Date: Sep. 13, 2022

(87) PCT Pub. No.: WO2021/183862
PCT Pub. Date: Sep. 16, 2021

(65) Prior Publication Data

US 2023/0122050 A1 Apr. 20, 2023

Related U.S. Application Data

(60) Provisional application No. 62/989,262, filed on Mar. 13, 2020.

(51) Int. Cl.
*C22C 26/00* (2006.01)
*B22F 1/18* (2022.01)
(Continued)

(52) U.S. Cl.
CPC ..... *C22C 26/00* (2013.01); *B22F 1/18* (2022.01); *C22C 1/101* (2013.01);
(Continued)

(58) Field of Classification Search
CPC .... B22F 1/18; B22F 2301/15; B22F 2302/40; B22F 2304/10; E21B 10/56; E21B 10/567;
(Continued)

(56) References Cited

U.S. PATENT DOCUMENTS 3,841,852 A * 10/1974 Wilder ..... B24D 3/08 51/307
8,702,824 B1 4/2014 Sani et al.
(Continued)

FOREIGN PATENT DOCUMENTS

CN 105903972 8/2016
WO WO-2021183862 A1 9/2021

OTHER PUBLICATIONS

"International Application Serial No. PCT/US2021/022076, International Search Report mailed May 25, 2021", 2 pgs.
(Continued)

*Primary Examiner* — Cathleen R Hutchins
(74) *Attorney, Agent, or Firm* — Schwegman Lundberg & Woessner, P.A.

(57) ABSTRACT

A polycrystalline composite tool component and associated methods are disclosed. In one example plurality of diamond particles are coated with a conforming catalyst metal coating and a plurality of graphene particles. Various asymmetric distributions of graphene particles are shown that provide a variety of material properties.

14 Claims, 9 Drawing Sheets

(51) Int. Cl.
*C22C 1/10* (2023.01)
*E21B 10/567* (2006.01)
*B22F 5/00* (2006.01)

(52) U.S. Cl.
CPC .... *E21B 10/5676* (2013.01); *B22F 2005/001* (2013.01); *B22F 2301/15* (2013.01); *B22F 2302/406* (2013.01); *B22F 2304/10* (2013.01); *B22F 2998/10* (2013.01)

(58) Field of Classification Search
CPC ..... E21B 10/5673; E21B 10/5676; E21B 10/5735
See application file for complete search history.

(56) References Cited

U.S. PATENT DOCUMENTS 8,911,521 B1 12/2014 Miess et al.
2010/0032215 A1 2/2010 Shao et al.
2010/0166635 A1* 7/2010 Sung ..... C01B 32/25 423/446
2011/0052803 A1* 3/2011 Bao ..... C04B 35/62892 264/653
2012/0037429 A1* 2/2012 Davies ..... B24D 99/005 175/428
2012/0037431 A1* 2/2012 DiGiovanni ..... E21B 10/567 175/428
2012/0102843 A1 5/2012 Chakraborty et al.
2012/0281938 A1 11/2012 Peterson et al.
2014/0013672 A1 1/2014 Malik et al.
2014/0154509 A1 6/2014 Zhang et al.
2015/0136495 A1 5/2015 Knuteson et al.
2017/0191318 A1* 7/2017 Chakraborty ..... C09K 3/1436
2019/0247928 A1 8/2019 Zhang et al.

OTHER PUBLICATIONS

"International Application Serial No. PCT/US2021/022076, Written Opinion mailed May 25, 2021", 5 pgs.
"International Application Serial No. PCT US2021 022076, International Preliminary Report on Patentability mailed Sep. 22, 2022", 7 pgs.
"European Application Serial No. 21768906.6, Response to Communication pursuant to Rules 161(2) and 162 EPC filed Apr. 11, 2023", 17 pgs.
"Saudi Arabian Application Serial No. 522440504, Substantive Examination Report mailed Dec. 26, 2023", w English Translation, 12 pgs.
"European Application Serial No. 21768906.6, Extended European Search Report mailed Feb. 29, 2024", 17 pgs.
"Saudi Arabian Application Serial No. 522440504, Response filed Apr. 23, 2024 to Substantive Examination Report mailed Dec. 26, 2023", w English claims, 17 pgs.
"Saudi Arabian Application Serial No. 524452128, Voluntary Amendment filed Jul. 21, 2024", w English claims, 7 pgs.
"European Application Serial No. 21768906.6, Response filed Sep. 17, 2024 to Extended European Search Report mailed Feb. 29, 2024", 12 pgs.
"Saudi Arabian Application Serial No. 524452128, Response filed Aug. 3, 2025 to Substantive Examination Report mailed Apr. 29, 2025", w/English claims, 59 pgs.
"Saudi Arabian Application Serial No. 524452128, Substantive Examination Report mailed Apr. 29, 2025", w/o English Translation, 8 pgs.

* cited by examiner

DRILL BIT COMPACT AND METHOD INCLUDING GRAPHENE

CLAIM OF PRIORITY

This application is a U.S. National Stage Filing under 35 U.S.C. 371 from International Application No. PCT/US2021/022076, filed on Mar. 12, 2021, which claims the benefit of priority of U.S. Provisional Patent Application Ser. No. 62/989,262, entitled "DRILL BIT COMPACT AND METHOD INCLUDING GRAPHENE," filed on Mar. 13, 2020, each of which application are incorporated by reference herein in their entirety.

TECHNICAL FIELD

Embodiments described herein generally relate to tooling materials, tool configurations, and associated methods.

BACKGROUND

Composite materials using polycrystalline diamond are useful for a number of industries, including, but not limited to drilling through rock formations for exploration of oil and gas. Improved toughness, thermal conductivity and other properties are desired to form improved polycrystalline diamond containing composite tool components.

DESCRIPTION OF EMBODIMENTS

The following description and the drawings sufficiently illustrate specific embodiments to enable those skilled in the art to practice them. Other embodiments may incorporate structural, logical, electrical, process, and other changes. Portions and features of some embodiments may be included in, or substituted for, those of other embodiments. Embodiments set forth in the claims encompass all available equivalents of those claims.

Figure 1:
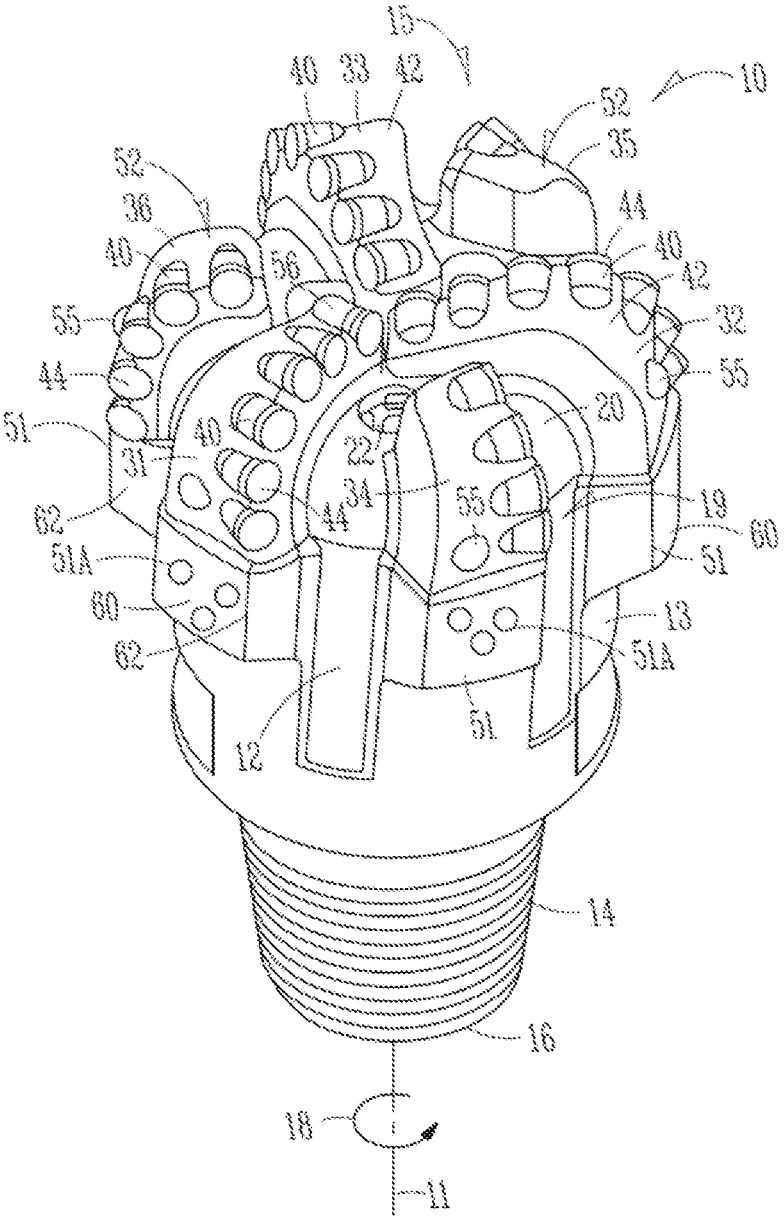
FIG. 1 shows an isometric view of a drill head in accordance with some example embodiments.

FIG. 1 shows one example of a drill head 10. In the example of FIG. 1, the drill head 10 is a fixed cutter PDC bit adapted for drilling through formations of rock to form a borehole. Drill head 10 generally includes a body 12, a shank 13 and a threaded connection or pin 14 for connecting bit 10 to a drill string (not shown), which is employed to rotate the drill head in order to drill the borehole. Bit face 20 supports a cutting structure 15 and is formed on the end of the drill head 10 that is adapted to face the rock formation when in use, and is generally opposite pin end 16. Drill head 10 further includes a central axis 11 about which drill head 10 rotates in the cutting direction represented by arrow 18. As used herein, the terms "axial" and "axially" generally mean along or parallel to a given axis (e.g., drill head axis 11), while the terms "radial" and "radially" generally mean perpendicular to the axis. For instance, an axial distance refers to a distance measured along or parallel to a given axis, and a radial distance refers to a distance measured perpendicular to the axis.

Body 12 may be formed from a composite of tungsten carbide particles in a binder matrix material. Alternatively, the body can be formed from other materials, such as tool steel, rather than a carbide composite.

Figure 3:
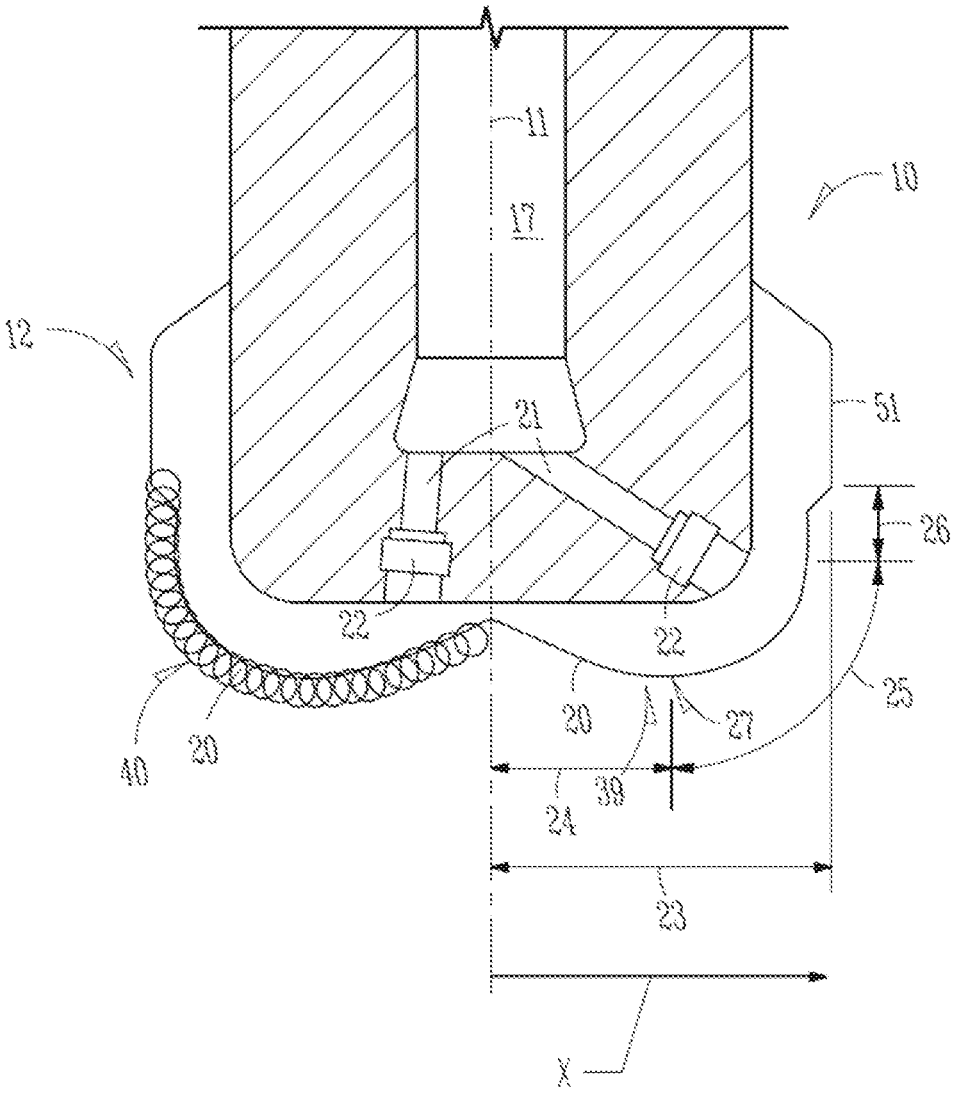
FIG. 3 shows a cross section view of the drill head from FIGS. 1 and 2 in accordance with some example embodiments.

In one example shown in FIG. 3, body 12 includes a central longitudinal bore 17 permitting drilling fluid to flow from a drill string into drill head 10. In the example of FIG. 3, the Body 12 is also provided with downwardly extending flow passages 21 having ports or nozzles 22 disposed at their lowermost ends. The flow passages 21 are in fluid communication with central bore 17. Together, passages 21 and nozzles 22 serve to distribute drilling fluids around cutting structure 15 to flush away formation cuttings during drilling and to remove heat from drill head 10.

Referring again to FIGS. 1 and 2, cutting structure 15 is provided on face 20 of drill head 10 and includes a plurality of blades which extend from bit face 20. The bit face 20 includes different regions that experience different levels of stress when in operation. For example, a shoulder region **20*a* experiences higher stress than a nose region 20*b*. In the embodiment illustrated in FIGS. 1 and 2, cutting structure 15 includes six blades 31, 32, 33, 34, 35, and 36. In this embodiment, the blades are integrally formed as part of, and extend from, bit body 12 and bit face 20. The blades extend generally radially along bit face 20 and then axially along a portion of the periphery of drill head 10. In particular, blades 31, 32, 33 extend radially from proximal central axis 11 toward the periphery of drill head 10. Blades 34, 35, 36 are not positioned proximal bit axis 11, but rather, extend radially along bit face 20 from a location that is distal bit axis 11 toward the periphery of drill head 10. Blades 31, 32, 33 and blades 34, 35, 36 are separated by drilling fluid flow courses 19**.

Figure 2:
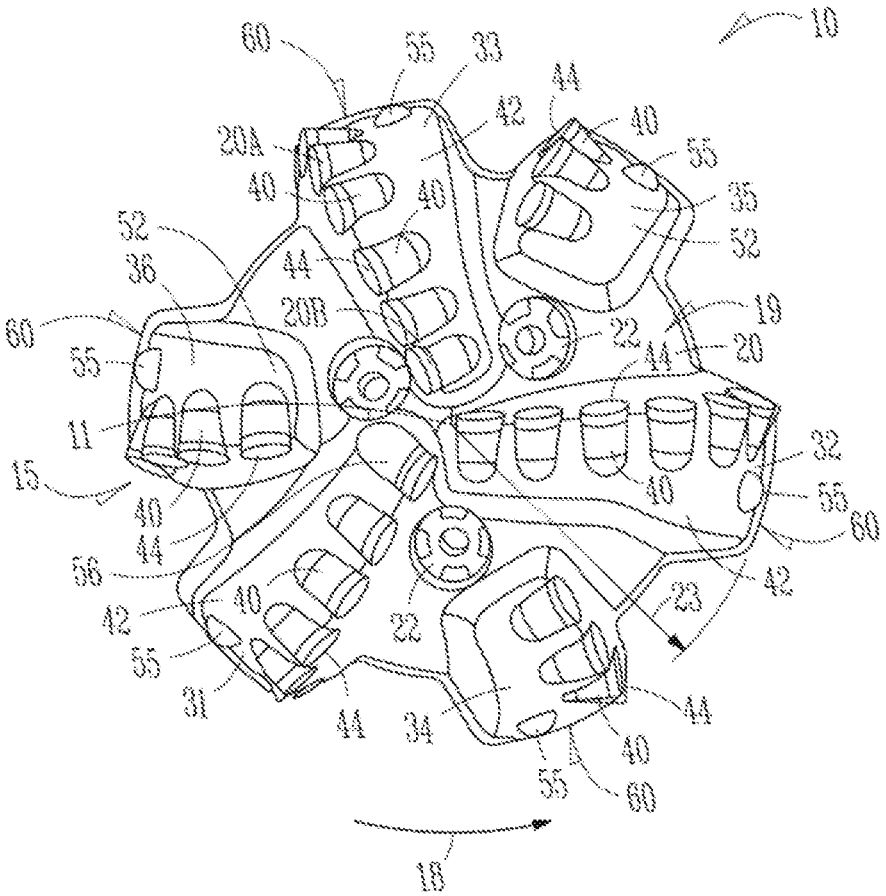
FIG. 2 shows a top view of the drill head from FIG. 1 in accordance with some example embodiments.

Referring still to FIGS. 1 and 2, each blade, 31, 32, 33 includes a cutter-supporting surface 42 for mounting a plurality of cutter elements, and blade 34, 35, and 36 includes a cutter-supporting surface 52 for mounting a plurality of cutter elements. A plurality of forward-facing cutter elements 40, each having a primary cutting face 44, are mounted to cutter-supporting surfaces 42, 52 of blades 31, 32, 33 and blades 34, 35, 36, respectively. In particular, cutter elements 40 are arranged adjacent to one another in an extending row proximal the leading edge of blade 31, 32, 33

34, 35, and 36. Also mounted to cutter-supporting surfaces 42, 52 are inserts 55 that trail behind certain cutter elements 40.

Referring still to FIGS. 1 and 2, drill head 10 further includes gage pads 51 of substantially equal axial length measured generally parallel to bit axis 11. Gage pads 51 are disposed about the circumference of drill head 10 at angularly spaced locations. Specifically, gage pads 51 intersect and extend from each blade 31-36. In one example, gage pads 51 are integrally formed as part of the bit body 12.

Gage-facing surface 60 of gage pads 51 abut the sidewall of the borehole during drilling. The pads can help maintain the size of the borehole by a rubbing action when cutter elements 40 wear slightly under gage. Gage pads 51 also help stabilize bit 10 against vibration. In certain embodiments, gage pads 51 include flush-mounted or protruding cutter elements 51*a* embedded in gage pads to resist pad wear and assist in reaming the side wall, Therefore, as used herein, the term "cutter element" is used to include at least the above-described forward-facing cutter elements 40, blade inserts 55, and flush or protruding elements 51*a* embedded in the gage pads, all of which may be made in accordance with the principles described herein.

The drill head 10 illustrated in FIG. 1-3 is shown as one example of a drill tool that may use composite material structures as described in more detail below. Other drill head configurations, such as cone drill heads, or other rock drill heads are also within the scope of the invention. Additionally, apart from drill heads, composite materials described in the present disclosure may be used in any of a number of hard material and/or abrasive resistant tool applications apart from rock drilling.

Figure 4:
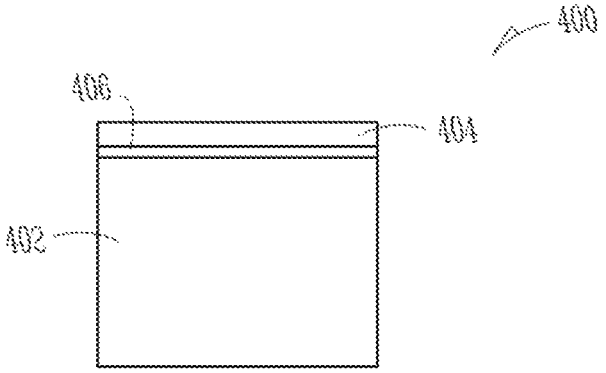
FIG. 4 shows a side view of a composite tool component in accordance with some example embodiments.

FIG. 4 illustrates a polycrystalline diamond compact 400 according to one embodiment. A polycrystalline diamond layer 404 is shown on a surface of a substrate 402. In one example, the substrate 402 includes tungsten carbide. In one example, the substrate 402 includes a tungsten carbide composite material having a plurality of tungsten carbide particles embedded in a matrix material. In one example, the matrix material is cobalt. In one example, the matrix material is nickel. Although cobalt and nickel are discussed as examples, the invention is not so limited. Other examples may include tungsten carbide embedded in other metal matrix materials, or alloys that may include cobalt and/or nickel.

In one example, the polycrystalline diamond compact 400 is cylinder shaped, as shown in FIGS. 1-3. Other example geometries are also within the scope of the invention, such as triangular, square, oval, or other radial cross section geometries. In the context of a drill head 10, as shown in examples of FIGS. 1-3, a polycrystalline diamond compact 400 is discussed as one example of a composite tool component, however the invention is not so limited. In other examples of composite tool components, a polycrystalline diamond layer is located on one or more surfaces of a different type of substrate for application in a different field. For example, other abrasive tools may use a polycrystalline diamond layer on a different substrate shape for any of a number of cutting or abrading operations, such as grinding or machining metal fabricated components.

In one example, a bond region 406 is physically present between the polycrystalline diamond layer 404 and the substrate 402. One example of a bond region 406 includes a gradient of diffused matrix material from the substrate into the polycrystalline diamond layer. In manufacture, one example of attaching a polycrystalline diamond layer 404 to a substrate 402 includes placing a substrate in a hole inside a press tool. Polycrystalline diamond particles are then placed in the hole on top of the substrate, and the polycrystalline diamond particles are pressed tightly together. The substrate 402 and polycrystalline diamond particles are then heated to sinter, or otherwise attach together the polycrystalline diamond particles to one another and to the substrate 402.

In one example, during the heating process, some matrix material (for example cobalt or nickel) from the substrate may diffuse into the boundary between the polycrystalline diamond particles and the substrate 402. This will form a detectable gradient of matrix material between the final polycrystalline diamond layer 404 and the substrate 402. In one example, the concentration of matrix material will reflect matrix material loss from the substrate 402 at the interface as it diffuses upward into the polycrystalline diamond layer 404. The concentration of the matrix material may taper off as a distance from the boundary into the polycrystalline diamond layer 404 increases.

In one example, instead of diffusion of matrix material, an added braze material may be used to attach the polycrystalline diamond layer 404 to the substrate 402. A selected alloy or metal of braze may flow into interstitial spaces in the polycrystalline diamond layer 404 to help form a mechanical bond between the polycrystalline diamond layer 404 and the substrate 402. In addition to a mechanical bond, a chemical bond may exist between a chosen braze material and one or more components in the polycrystalline diamond layer 404 and the substrate 402.

In one example, graphene is added to the diamond particles during processing as described above. In one example, a conforming catalyst metal is further used to coat one or more of the diamond particles.

Figure 5:
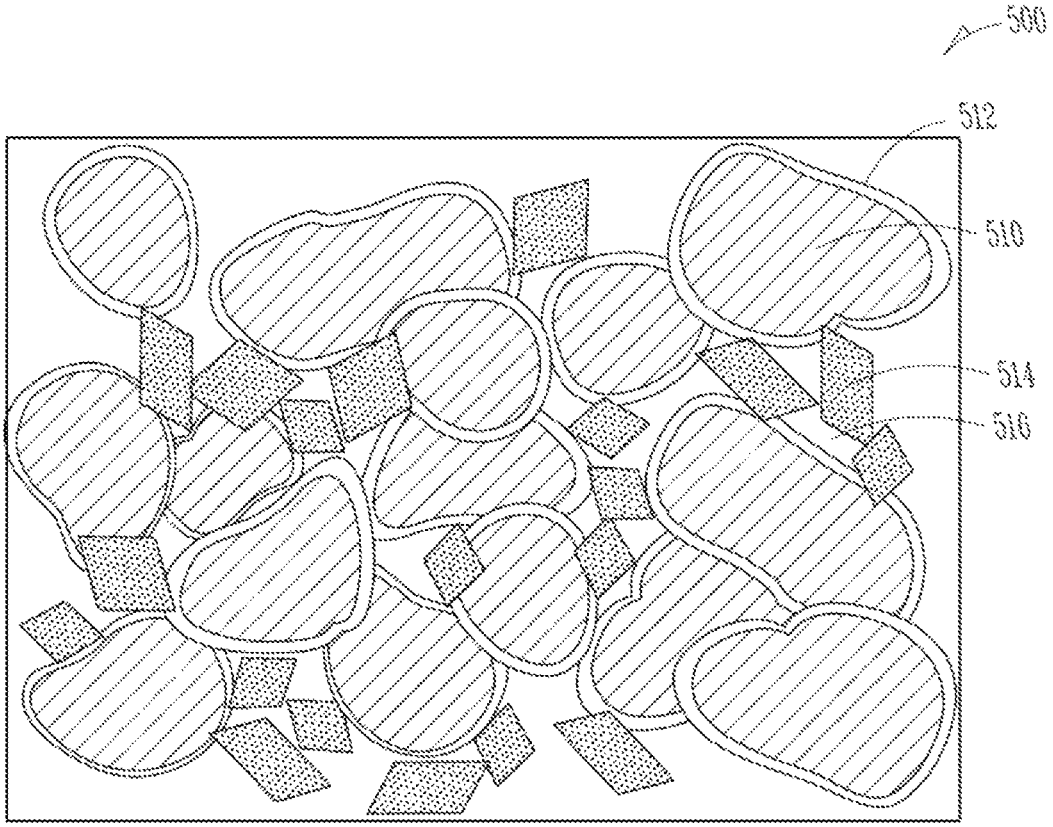
FIG. 5 shows a diagram of a composite material microstructure during manufacture in accordance with some example embodiments.

FIG. 5 shows a diagram of a portion of a polycrystalline diamond layer 500. In one example the polycrystalline diamond layer 500 is similar to the polycrystalline diamond layer 404 from FIG. 4. The polycrystalline diamond layer 500 includes a plurality of diamond particles 510, In one example, the plurality of diamond particles 510 include diamond particles of grain size between 0.05 μm and 3.00 μm. In one example, the plurality of diamond particles 510 include diamond particles of grain size between 2.0 μm and 60.0 μm.

The plurality of diamond particles 510 are shown with a conforming catalyst metal 512 coating the diamond particles 510. A plurality of graphene particles 514 are further shown located within interstitial spaces 516 of the plurality of diamond particles 510. In one example, the conforming catalyst metal 512 also coats the graphene particles 514. In one example, the plurality of diamond particles 510 are coated in a separate operation from coating of the graphene particles 514. In one example, the plurality of diamond particles 510 are coated in the same coating operation as the graphene particles 514.

In one example the plurality of graphene particles 514 are 3D graphene particles that include multiple clustered sheets of graphene grown together at different angles with respect to one another. In one example the plurality of graphene particles 514 are 2D graphene particles that include flat sheets of graphene. In one example, the graphene particles 514 are substantially all single layer graphene. In one example, the graphene particles 514 include multiple layer graphene. In one example, the graphene particles 514 are substantially 97 percent pure graphene. High quality and highly uniform graphene provides increased strength of a resulting polycrystalline diamond layer.

In one example a first distribution of 3D graphene particles and a second distribution of 2D graphene particles are incorporated into a tool region. 3D graphene particles can be more expensive than 2D graphene particles. In one example, 3D graphene particles are preferentially distributed to tool regions with higher physical and chemical demands. In one example, 3D graphene particles are preferentially distributed at an exposed tool edge, including but not limited to a cutting edge. 2D graphene particles may be less expensive than 3D graphene particles, but still more expensive that normal diamond particles. In one example, 2D graphene particles are preferentially distributed at an internal interface between a top diamond particle layer and a substrate, such as tungsten carbide or steel. In one example, 2D graphene particles are preferentially distributed at an internal interface between two diamond particle layers. Examples of internal diamond particle layers include, but are not limited to, leached layers, unleached layers, different diamond grain size layers, etc.

As discussed in more detail below, a polycrystalline diamond layer may be leached after sintering with acid or other chemicals to remove metal such as cobalt or other binder/catalyst materials from interstitial spaces between diamond particles. Leaching may provide increased thermal tolerance of the polycrystalline diamond layer, and decrease cracking due to coefficient of thermal expansion (CTE) mismatch between cobalt and diamond particles.

Introduction of graphene at an interface between a leached layer and an unleached layer may provide enhanced bonding strength where material properties such as CTE are changing. In selected examples, graphene particles have a greater affinity to diamond particles of a certain grain size. An addition of graphene at an interface between different layers of different diamond grain size may strengthen the interface. Selection of particle size may enhance localized concentration of graphene particles due to preferential affinity.

In one example, the conforming catalyst metal 512 includes cobalt. In one example, the conforming catalyst metal 512 includes nickel. In selected examples, the conforming catalyst metal 512 may include a substantially pure metal. In other selected examples, the conforming catalyst metal 512 may include an alloy metal. In one example, the conforming catalyst metal 512 is continuous and uninterrupted around a surface of the plurality of diamond particles 510. In one example, the conforming catalyst metal 512 is continuous and uninterrupted around a surface of the plurality of graphene particles 514. In one example, the conforming catalyst metal 512 includes a number of substantially homogenous sized and shaped particles deposited in one or more methods described below.

In one example, the conforming catalyst metal 512 is chemically deposited onto the plurality of diamond particles 510 and/or the plurality of graphene particles 514 using one or more chemical precursors. In one example, atomic layer deposition techniques are used to control a thickness of the conforming catalyst metal 512. One atomic layer of conforming catalyst metal 512 is used in one example. Multiple atomic layer deposition operations may be used to build up several atomic layers of the conforming catalyst metal 512. Although chemical deposition is described, other methods may be used to form the conforming catalyst metal 512, such as physical vapor deposition, etc.

In one example, the conforming catalyst metal 512 includes nanoparticles. In one example, after deposition of one or more chemical precursors, the precursors are reacted to form the conforming catalyst metal 512. In one example, a layer of metal particles results from reacting the one or more chemical precursors. As a result of the process, nanoparticles in the conforming catalyst metal 512 are evenly distributed with a tight distribution of particle size. This configuration leads to improved reaction and sintering between particles as a result of more predictable reactions at contact points between particles.

In one example, nanoparticles include nano-cobalt. In one example, nanoparticles include nano-nickel. Other catalyst metals or metal alloy nanoparticles are within the scope of the invention. For example, elements found in Group VIII of the periodic table and/or combinations of elements from Group VIII may also be used as catalyst metals in configurations described in the present disclosure.

In one example, the conforming catalyst metal 512 facilitates adhesion of the plurality of graphene particles 514 to surfaces of the plurality of diamond particles 510. The catalyzed adhesion may provide a more distributed mixing of graphene particles 514, and provide increased strength to the polycrystalline diamond layer 500 after sintering.

In one example, catalyst metal 512 is not used. In one example, sonication is used to evenly distribute the plurality of graphene particles 514 within the plurality of diamond particles 510. An advantage of not using catalyst includes similar benefits to leaching as discussed above. An absence of metal in interstitial spaces may decrease cracking due to coefficient of thermal expansion (CTE) mismatch between cobalt and diamond particles. In one example, a combination of different tool regions are formed using graphene/diamond mixtures formed by different mixing methods. For example, a higher quality but more expensive tool region may be formed using conforming catalyst mixing methods as described above, while a good quality, but less expensive tool region may be formed using sonication mixing methods as described above. Examples of different too regions may include, but are not limited to vertical tool layers. Other different regions of a tool may include external walls of a tool cylinder compared to a central axis of a tool cylinder.

One method of manufacture of a composite tool component includes placing diamond particles and graphene particles into a hole in a pressing tool. After particles are in the pressing tool, a piston is driven into the hole to compact the particles into a green state (compressed state). The compressed particles are then heated to cause sintering of the particles into a state shown in FIG. 6. In one example, different powders may be preferentially loaded into the hole in the pressing tool in different orders, different concentrations, on different surfaces, in different layers, etc. such as to result in a composite tool component with graphene particles that are asymmetrically distributed.

In one example, conforming catalyst mixed diamond particles may be pressed in a tool in a first operation, and sonication mixed diamond particles may be pressed in the tool in a second operation. In one example, the double press operation order may be reversed, or multiple pressing operations in addition to two presses may be used.

Figure 6:
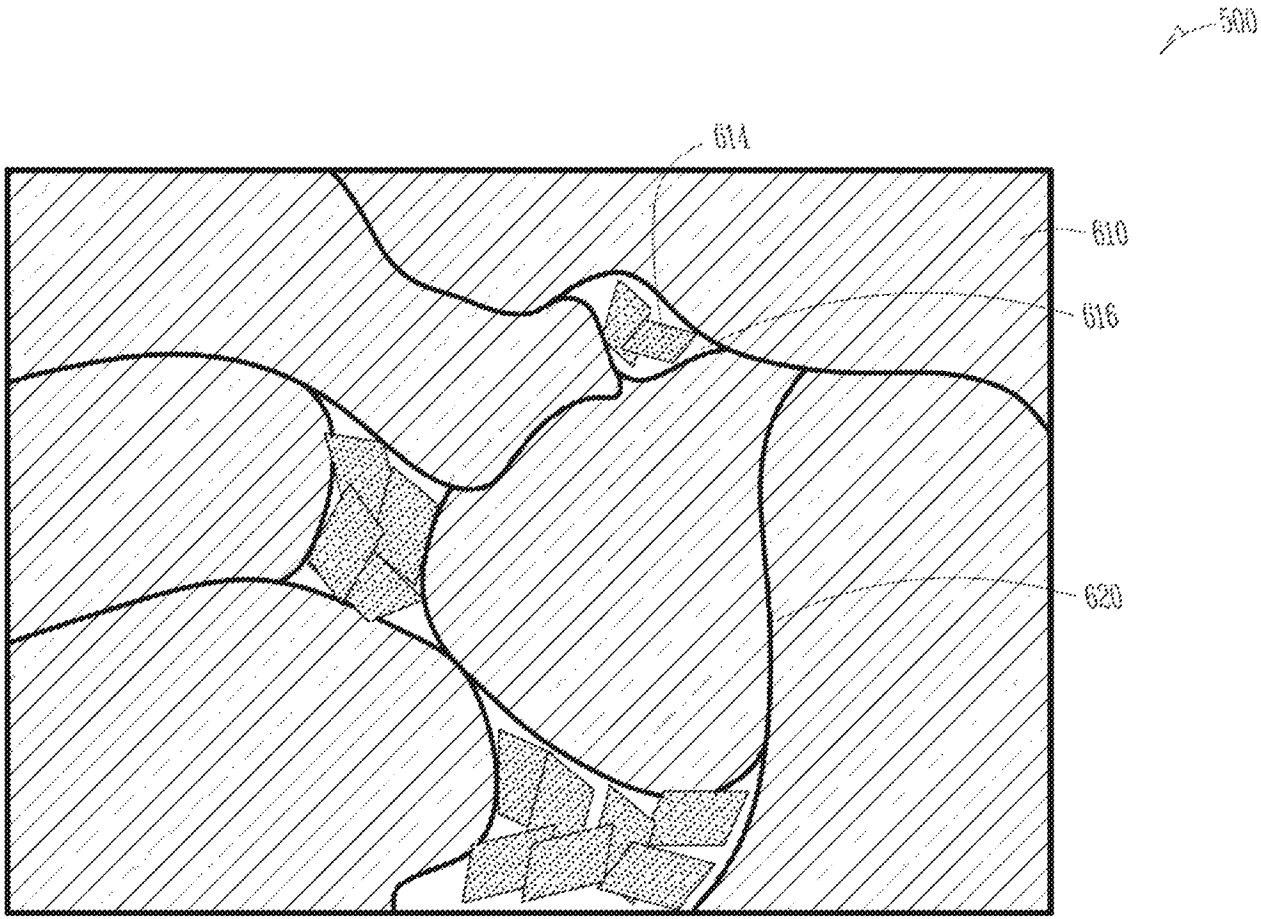
FIG. 6 shows a diagram of a resulting composite material microstructure in accordance with some example embodiments.

FIG. 6 shows the polycrystalline diamond layer 500 after sintering. The plurality of diamond particles 510 have changed to form diamond particles 610. The interfaces 620 between diamond particles 510 are connected at points or larger surfaces as shown. In one example the interfaces 620 contain detectable amounts of catalyst metal 512 from the previous condition shown in FIG. 5. FIG. 6 further shows graphene particles 614 that may include residual from graphene particles 514, and transformed particles to form graphene particles 614. In one example, as shown in FIG. 6, remaining interstitial spaces 616 are reduced after sintering, providing densification of the polycrystalline diamond layer 500, and adding strength.

In other examples of composite tool components, graphene may be incorporated into polycrystalline diamond layers in one or more asymmetric or gradiated ways. In one example, graphene is added on top of a plurality of diamond particles and pressed before sintering. This will yield a higher concentration of graphene at a surface of the polycrystalline diamond layer. In one example, this will provide increased strength to the surface of the polycrystalline diamond layer.

Figure 8:
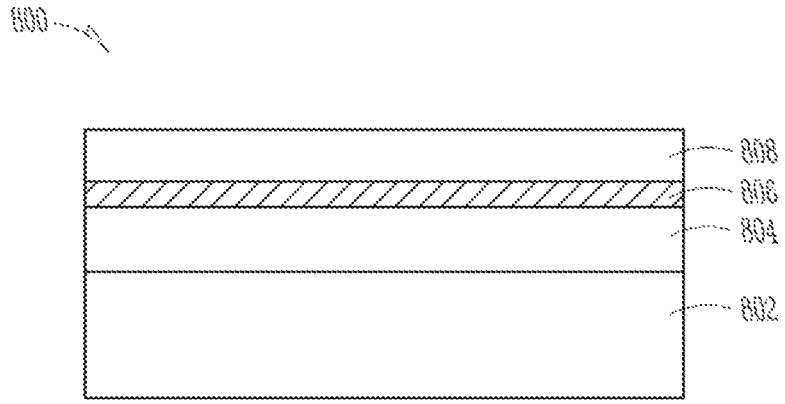
FIG. 8 shows a side view of a composite tool component in accordance with some example embodiments.

FIG. 8 shows a composite tool component 800 according to one example. The composite tool component 800 includes a substrate region 802, a first diamond particle layer 808, and a second diamond particle layer 804. In one example, the first diamond particle layer 808 includes a different microstructure, and different matetial properties from the second diamond particle layer 804. Examples of different properties include leaching differences, grain size differences, presence of metal in interstitial spaces, etc. In one example, the first diamond particle layer 808 is substantially free of interstitial metal. In one example the absence of interstitial metal is a result of a leaching operation. In one example the absence of interstitial metal is a result of a not including a catalyst or binder metal in pressing and firing the layer.

FIG. 8 shows a concentration of graphene particles 806 at an interface between the first diamond particle layer 808 and the second diamond particle layer 804. In one example, the concentration of graphene particles 806 is formed by layering graphene on top of the second diamond particle layer 804, and subsequently layering the first diamond particle layer 808 during pressing and firing. In one example, the second diamond particle layer 804 includes a concentration of graphene particles 806 that are more heavily concentrated at a top portion, or otherwise migrate to region 806 during pressing and firing.

In one example asymmetric distribution of a plurality of graphene particles is included within a single region of diamond particles. One example method includes using a paste of graphene particles and preferentially coating one or more regions within a mold prior to firing the green state component. In one example a hole in a pressing tool is used and walls or portions of walls of the hole are coated with the graphene particle paste. Diamond particles may then be added in a central axis region of the hole. When fired, the edges of the resulting cylinder will have a higher concentration of graphene particles than in the central axis portion. This is useful, because edges of many tools, such as cutting tools are in direct abrasive contact with the medium, such as rock. The edges benefit mostly from the enhanced properties of the graphene, while the central region is more cost effective with less graphene.

Although a graphene paste is used as one example of a technique to provide asymmetric distribution of graphene, the invention is not so limited. In another example, a ring may be formed by placing a mandrel within the hold in the pressing tool. Graphene particles may then be placed only in the outer edges of a cylinder as directed by the mandrel and sides of the hole.

Figure 9:
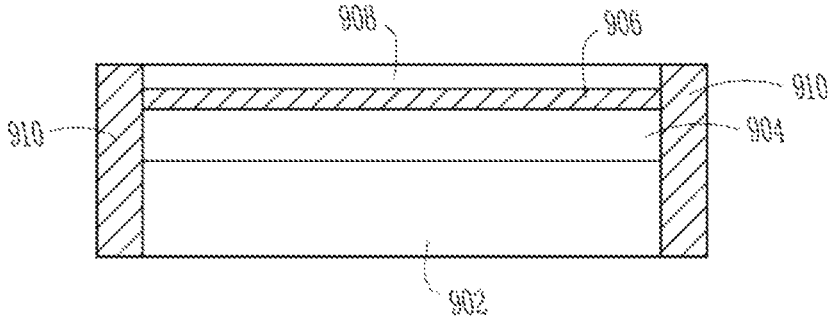
FIG. 9 shows a side view of another composite tool component in accordance with some example embodiments.

FIG. 9 shows a composite tool component 900 according to one example. The composite tool component 900 includes a substrate region 902, a first diamond particle layer 908, and a second diamond particle layer 904. In one example, the first diamond particle layer 908 includes a different microstructure, and different material properties from the second diamond particle layer 904. Similar to FIG. 8, FIG. 9 shows a concentration of graphene particles 906 at an interface between the first diamond particle layer 908 and the second diamond particle layer 904. As described in example methods above, FIG. 9 further shows a ring, or cylinder shell region 910 where a plurality of graphene particles are located in higher concentration about cylinder walls than in a central axis of the cylinder. Although FIG. 9 shows both a concentration of graphene particles 906 and a cylinder shell region 910 with graphene, the invention is not so limited. One of the graphene regions 906, 910 or both may be included in selected examples.

As discussed above, in one example the graphene region 906 is different than graphene region 910. In one example, graphene region 906 includes 2D graphene, and graphene region 910 includes 3D graphene. Although two different graphene regions 906, 910 are shown, three or more graphene regions are also within the scope of the invention.

Figure 10:
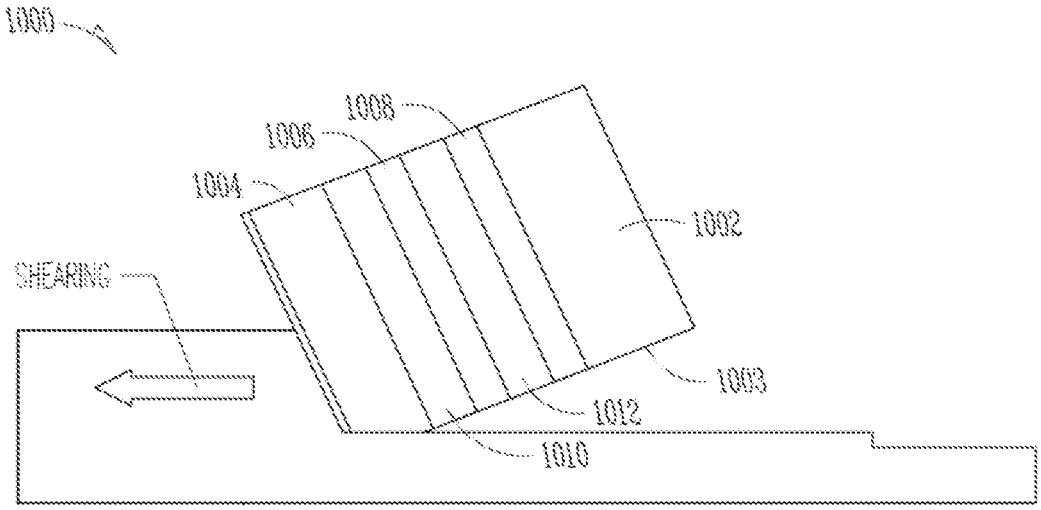
FIG. 10 shows a side view of another composite tool component in accordance with some example embodiments.

For example, FIG. 10 shows a composite tool component 1000 according to one example. The composite tool component 1000 of FIG. 10 includes a substrate 1002, and a leading diamond particle layer 1004. A second diamond particle layer 1006 and a third diamond particle layer 1008 are further shown. In one example, one or more of the diamond particle layers 1002, 1004, 1006 includes graphene. In one example, one or more of the diamond particle layers 1002, 1004, 1006 includes asymmetrically distributed graphene. In the example of FIG. 10, the diamond particle layers 1002, 1004, 1006 are separated by tungsten carbide layers 1010, 1012. Configurations that utilize multiple layers such as FIG. 10 provide larger surface area (longer) high wear sides 1003 while keeping manufacturing costs low by reducing an amount of diamond and/or graphene. Additionally, the alternating layers of diamond and tungsten carbide provide a saw blade like effect and present multiple hard edges to a material being drilled such as rock as the sides 1003 wear.

Figure 11:
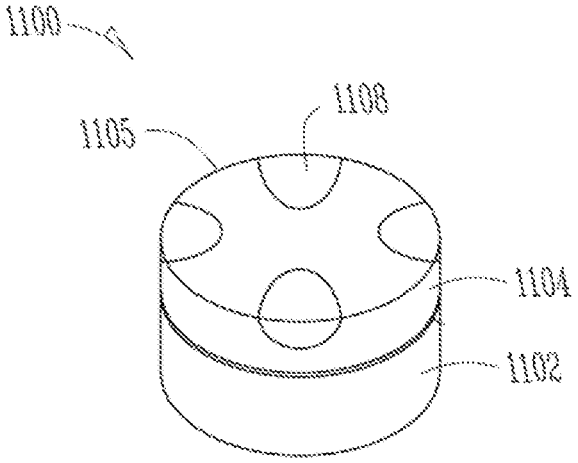
FIG. 11 shows an isometric view of another composite tool component in accordance with some example embodiments.

Another asymmetric distribution of graphene particles is shown in FIG. 11. FIG. 11 shows composite tool component 1100 having a substrate 1102, and a first region 1104, including a plurality of diamond particles A number of graphene concentrated regions 1108 are shown on an exposed edge 1105 of the first region 1104. The configuration of FIG. 11 is useful in tooling where the composite tool component 1100 can be indexed to one or more of the graphene concentrated regions 1108 as earlier regions 1108 become worn. In the example of FIG. 11, four index regions are shown. Other numbers are also within the scope of the invention. By only concentrating the graphene is selected regions 1108, the more expensive graphene particles are only utilized in regions where it is most needed to strengthen the first region and reduce wear.

Figure 12:
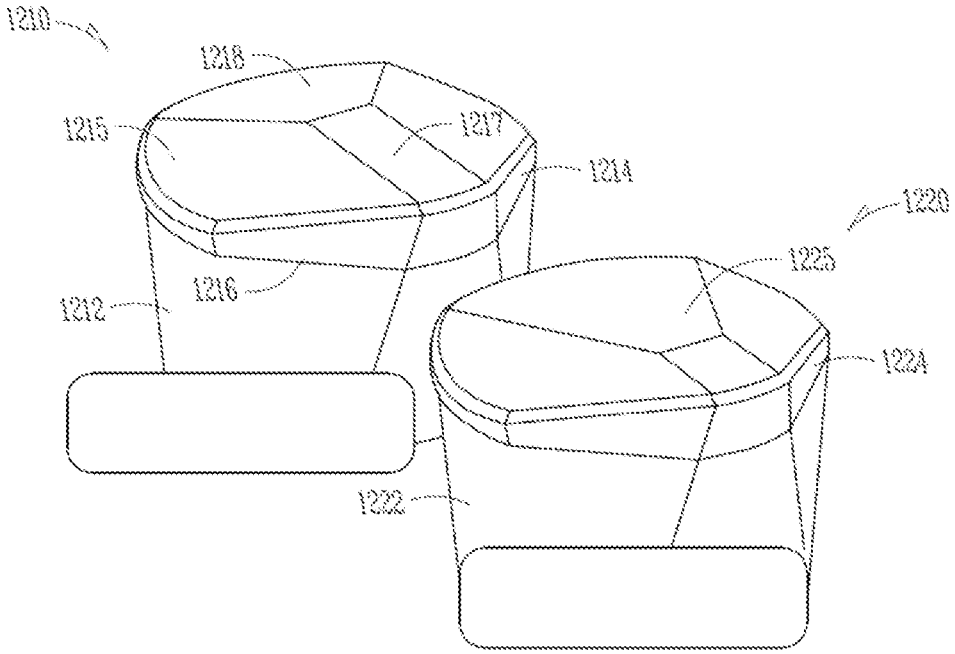
FIG. 12 shows an isometric view of two composite tool component in accordance with some example embodiments.

FIG. 12 shows two additional examples of composite tool components 1210 and 1220. The examples of FIG. 12 show shaped cutters. Composite tool component 1210 may be formed initially from a cylinder, although the invention is not so limited. In one example, the composite tool component 1210 is pressed in a non-cylindrical shape initially. The composite tool component 1210 includes a substrate 121 1212 such as tungsten carbide or steel and a first region 1214, including a plurality of diamond particles. Shaping of the composite tool component 1210 includes a flattened sidewall 1216, and a recessed trough 1217. Edges 1218 are sharpened to an acute angle as a result of the recessed trough 1217. In one example, all or a portion of an upper exposed surface 1215 of the first region 1214 includes a plurality of graphene particles asymmetrically distributed primarily near the surface. As shown in FIG. 12, the upper exposed surface

1215 is a non-planar surface of the first region. In one example, the complex geometry of the upper exposed surface 1215 is first pressed into the complex geometry in the green state. Graphene may then be added to the upper exposed surface 1215 before pressing or in a second pressing operation for example. After firing, the graphene will be asymmetrically distributed in the non-planar surface and provide increased strength and wear, without the added cost of distributing more graphene throughout the first region 1214.

Additional distributions of graphene, as described in other examples above, may also be incorporated into composite tool components 1210 and 1220. For example a ring concentration as described in FIG. 9 may be included, and/or an interface layer below the first region 1214 may be included, Composite tool component 1220 is similar to composite tool component 1210 with variations in the geometry of the upper exposed surface 1215. In the example shown, composite tool component 1220 includes a substrate 1222 and a first region 1224 with an upper exposed surface 1225. The recessed trough and edge geometries of composite tool component 1220 are different from composite tool component 1210.

In one example, a shaped composite tool component such as composite tool components 1210, 1220 may be formed by depositing a base layer of diamond particles within a hole in a press tool as described above. A non-planar surface may be pressed into the first region, and a layer of graphene deposited over the non-planar surface. Then a remaining portion of the hole in the press tool may be filled with a sacrificial powder including, but not limited to, additional diamond particles. After pressing and firing, the sacrificial region formed by the sacrificial powder may be removed to expose the desired non-planar surface with graphene. Examples of removing the sacrificial region include, but are not limited to, laser ablation, etching, grinding, etc. In one example, the graphene buried beneath the sacrificial region may provide a natural stop for removal, such as an etch stop due to different hardness of the graphene layer. In one example, the addition of graphene will improve a surface finish of the non-planar surface due to the presence of graphene filling interstitial regions between diamond grains.

In select examples of composite tool components, a polycrystalline diamond layer is leached after sintering to remove selected materials such as cobalt or other catalyst material. Leaching may provide increased thermal tolerance of the polycrystalline diamond layer, and decrease cracking due to coefficient of thermal expansion (CTE) mismatch between cobalt and diamond particles. In one example, after leaching, graphene is added to reinforce the interstitial spaces left behind by the leaching process. The presence of the graphene only in the leached region is detectable as a gradient, and provides localized strengthening without sacrificing thermal conductivity or inducing CTE cracking because a CTE of graphene is similar to that of diamond. In one example, a graphene layer below an exposed surface of a diamond particle layer serves as a leaching barrier at a desired depth. In such an example, a region above a graphene layer may be more thoroughly leached, while a region below a graphene layer may show improved adhesion to substrates due to the presence of interstitial metal binder or catalyst.

In one example, multiple layers of polycrystalline diamond may be used to form a composite tool component. A grain size of polycrystalline diamond in each of the different layers may be varied to provided selected mechanical properties of the composite tool component. In one example, layers of graphene may be added between different layers of polycrystalline diamond. In one example, different concentrations and/or particle sizes of graphene may be used to match properties and optimize each of the different grain size layers of polycrystalline diamond.

In one example, an amount of graphene is added to polycrystalline diamond particles as described in one or more examples above, and added in amounts designed to modify a thermal expansion coefficient of the polycrystalline diamond layer. In one example, an amount of graphene is selected to substantially match a CTE of the polycrystalline diamond layer with a substrate CTE. In one example, an amount of graphene is selected to substantially match a CTE of the polycrystalline diamond layer with a braze or interfacial layer CTE.

Figure 7:
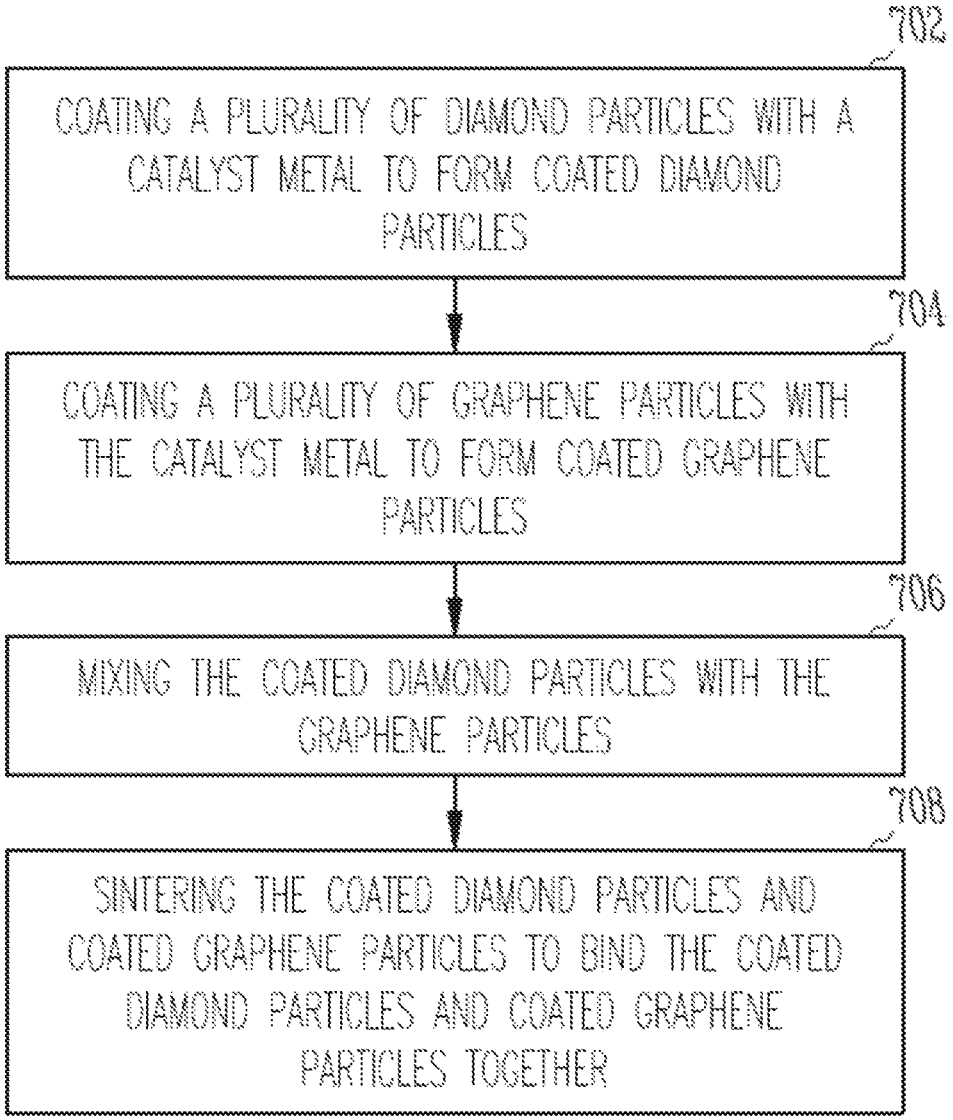
FIG. 7 shows a flow diagram of a method of making a composite material in accordance with some example embodiments.

FIG. 7 shows an example method of manufacturing a composite tool. In operation 702, a plurality of diamond particles are coated with a catalyst metal to form coated diamond particles. In operation 704, a plurality of graphene particles are coated with the catalyst metal to form coated graphene particles. In operation 706, the coated diamond particles are mixed with the graphene particles. In operation 708, the coated diamond particles and coated graphene particles are sintered to bind the coated diamond particles and coated graphene particles together.

As discussed above, asymmetric distribution of graphene can be beneficial in selected examples to enhance tool properties where needed, and to reduce tool cost in other less critical areas. Examples of asymmetric distribution include, but are not limited to, concentrations at cutting edges, exposed surfaces, and internal interfaces between layers. Different types of graphene, such as 2D and 3D may further be used in different asymmetric distribution locations to provide increased strength where needed, and reduced cost in less critical areas.

Additionally with reference to drill head 10 from FIG. 1, composite tool components with higher graphene enhancement may be used in locations on a drill head 10 that see greater stresses, while composite tool components with less or no graphene enhancement may be used in locations on a drill head 10 that see lower stresses. For example, a shoulder region of a drill head 10 may include composite tool components with higher graphene enhancement, while a nose region of a drill head 10 may include composite tool components with lower or no graphene enhancement. Further, components such as inserts 55 from drill head 10 may include some level (high or low) of graphene enhancement as described above. Inserts 55 in higher stress areas such as a shoulder region may preferentially include higher levels of graphene enhancement.

To better illustrate the method and apparatuses disclosed herein, a non-limiting list of embodiments is provided here:

Example 1 includes a composite tool component. The composite tool component includes, a plurality of diamond particles, a plurality of graphene particles located within the plurality of diamond particles, and a conforming catalyst metal coating the diamond particles and the graphene particles.

Example 2 includes the composite tool component of example 1, wherein the catalyst metal includes cobalt.

Example 3 includes the composite tool component of any one of examples 1-2, wherein the catalyst metal includes a group VIII element.

Example 4 includes the composite tool component of any one of examples 1-3, wherein the plurality of diamond particles include polycrystalline diamond particles.

Example 5 includes the composite tool component of any one of examples 1-4, wherein the plurality of diamond particles include diamond. particles of grain size between 0.05 μm to 3.00 μm.

Example 6 includes the composite tool component of any one of examples 1-5, wherein the plurality of diamond particles include diamond particles of grain size between 2.0 μm to 60.0 μm.

Example 7 includes the composite tool component of any one of examples 1-6, wherein the plurality of graphene particles include 99 percent single layer graphene particles.

Example 8 includes the composite tool component of any one of examples 1-7, wherein the plurality of graphene particles include multiple layer graphene particles.

Example 9 includes a polycrystalline diamond compact (PDC). The PDC includes a substrate and a polycrystalline diamond layer on one or more surface of the substrate. The polycrystalline diamond layer includes a plurality of diamond particles, a plurality of graphene particles located within the plurality of diamond particles, and a catalyst metal coating the diamond particles and the graphene particles.

Example 10 includes the PDC of example 9, wherein the substrate includes tungsten carbide.

Example 11 includes the PDC of any one of examples 9-10, wherein the bond between the polycrystalline diamond layer and the substrate includes a gradient of diffused cobalt from the substrate into the polycrystalline diamond layer.

Example 12 includes a drill head. The drill head includes a number of polycrystalline diamond compacts (PDC) attached to a drill head body. At least some of the polycrystalline diamond compacts include a substrate and a polycrystalline diamond layer bonded to the substrate. The polycrystalline diamond layer includes a plurality of diamond particles bonded to the substrate, a plurality of graphene particles located within the plurality of diamond particles, and a catalyst metal coating the diamond particles and the graphene particles.

Example 13 includes the drill head of example 12, wherein the drill head body includes a tricone body.

Example 14 includes the drill head of any one of examples 12-13, wherein the drill head body includes a plurality of fixed blades, one or more of the plurality of fixed blades having multiple PDCs coupled to an edge of the one or more fixed blades.

Example 15 includes a method of forming a composite tool. The method includes coating a plurality of diamond particles with a catalyst metal to form coated diamond particles, coating a plurality of graphene particles with the catalyst metal to form coated graphene particles, mixing the coated diamond particles with the graphene particles, and sintering the coated diamond particles and coated graphene particles to bind the coated diamond particles and coated graphene particles together.

Example 16 includes the method of example 15, further including leaching one or more outer surfaces of the composite tool after binding the coated diamond particles and coated graphene particles together.

Example 17 includes the method of any one of examples 15-16, wherein coating a plurality of diamond particles and a plurality of graphene particles includes coating from one or more precursor liquids.

Example 18 includes the method of any one of examples 15-17, wherein mixing the coated diamond particles with coated graphene particles includes mixing the coated diamond particles with coated 3D graphene particles.

Example 19 includes a composite tool component. The composite tool component includes a substrate, a first diamond particle layer substantially free of interstitial metal the first diamond particle layer attached to one or more surfaces of the substrate, a second diamond particle layer with interstitial metal, the second diamond particle layer located between the substrate and the first diamond particle layer, and a concentration of graphene particles at an interface between the first diamond particle layer and the second diamond particle layer.

Example 20 includes the composite tool component of example 19, wherein the composite tool is a cutter element.

Example 21 includes the composite tool component of example 19, wherein the composite tool is an insert.

Example 22 includes the site tool component of any one of examples 19-21, wherein the concentration of graphene particles are asymmetrically distributed within the second diamond particle layer.

Example 23 includes the site tool component of any one of examples 19-22, wherein the concentration of graphene particles are located in higher concentration about one or more edges of the second diamond particle layer.

Example 24 includes the site tool component of any one of examples 19-23, wherein the composite tool component includes a cylinder, and the concentration of graphene particles are located in higher concentration about cylinder walls than in a central axis of the cylinder.

Example 25 includes a composite tool component. The composite tool component includes a first region, including a plurality of diamond particles, a substrate region coupled to the first region, and a plurality of graphene particles located within the first region, wherein the plurality of grapheme particles are asymmetrically distributed within the first region.

Example 26 includes the composite tool component of example 25, wherein the plurality of graphene particles are located in higher concentration on a non-planar surface of the first region.

Example 27 includes the composite tool component of any one of examples 25-26, wherein the first region includes a cylinder, and wherein the plurality of grapheme particles are located in higher concentration at an exposed edge of the first region.

Example 28 includes the composite tool component of any one of examples 25-27, wherein the first region includes a cylinder, and wherein the plurality of graphene particles are located in higher concentration about cylinder walls than in a central axis of the cylinder.

Example 29 includes the composite tool component of any one of examples 25-28, wherein the plurality of graphene particles includes a first distribution of 3D particles and a second distribution of 2D particles.

Example 30 includes the composite tool component of any one of examples 25-29, wherein the first distribution is different from the second distribution.

Example 31 includes the composite tool component of any one of examples 25-30, wherein the first distribution of 3D particles is located on an exposed edge of the first region, and wherein the second distribution of 2D particles is located between the first region and the substrate.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

Although an overview of the inventive subject matter has been described with reference to specific example embodiments, various modifications and changes may be made to these embodiments without departing from the broader scope of embodiments of the present disclosure. Such embodiments of the inventive subject matter may be referred to herein, individually or collectively, by the term "invention" merely for convenience and without intending to voluntarily limit the scope of this application to any single disclosure or inventive concept if more than one is, in fact, disclosed.

The embodiments illustrated herein are described in sufficient detail to enable those skilled in the art to practice the teachings disclosed. Other embodiments may be used and derived therefrom, such that structural and logical substitutions and changes may be made without departing from the scope of this disclosure. The Detailed Description, therefore, is not to be taken in a limiting sense, and the scope of various embodiments is defined only by the appended claims, along with the full range of equivalents to which such claims are entitled.

As used herein, the term "or" may be construed in either an inclusive or exclusive sense. Moreover, plural instances may be provided for resources, operations, or structures described herein as a single instance. Additionally, boundaries between various resources, operations, modules, engines, and data stores are somewhat arbitrary, and particular operations are illustrated in a context of specific illustrative configurations. Other allocations of functionality are envisioned and may fall within a scope of various embodiments of the present disclosure. In general, structures and functionality presented as separate resources in the example configurations may be implemented as a combined structure or resource. Similarly, structures and functionality presented as a single resource may be implemented as separate resources. These and other variations, modifications, additions, and improvements fall within a scope of embodiments of the present disclosure as represented by the appended claims. The specification and drawings are, accordingly, to be regarded in an illustrative rather than a restrictive sense.

The foregoing description, for the purpose of explanation, has been described with reference to specific example embodiments. However, the illustrative discussions above are not intended to be exhaustive or to limit the possible example embodiments to the precise forms disclosed. Many modifications and variations are possible in view of the above teachings. The example embodiments were chosen and described in order to best explain the principles involved and their practical applications, to thereby enable others skilled in the art to best utilize the various example embodiments with various modifications as are suited to the particular use contemplated.

It will also be understood that, although the terms "first," "second," and so forth may be used herein to describe various elements, these elements should not be limited by these terms. These terms are only used to distinguish one element from another. For example, a first contact could be termed a second contact, and, similarly, a second contact could be termed a first contact, without departing from the scope of the present example embodiments. The first contact and the second contact are both contacts, but they are not the same contact.

The terminology used in the description of the example embodiments herein is for the purpose of describing particular example embodiments only and is not intended to be limiting. As used in the description of the example embodiments and the appended examples, the singular forms "a," "an," and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" may be construed to mean "when" or "upon" or "in response to determining" or "in response to detecting," depending on the context. Similarly, the phrase "if it is determined" or "if [a stated condition or event] is detected" may be construed to mean "upon determining" or "in response to determining" or "upon detecting [the stated condition or event]" or "in response to detecting [the stated condition or event]," depending on the context.

The invention claimed is:

1. A composite tool component, comprising:

a plurality of diamond particles;

a plurality of graphene particles located within the plurality of diamond particles; and a conforming catalyst metal coating the diamond particles and the graphene particles, separately from each other, with a consistent thickness of continuous metal about both the diamond particles and the graphene particles to provide improved reaction and sintering between the plurality of diamond particles and the plurality of graphene particles as a result of more predictable reactions at contact points between particles.

2. The composite tool component of claim 1, wherein the catalyst metal includes cobalt.

3. The composite tool component of claim 1, wherein the catalyst metal includes a group VIII element.

4. The composite tool component of claim 1, wherein the plurality of diamond particles include polycrystalline diamond particles.

5. The composite tool component of claim 1, wherein the plurality of diamond particles include diamond particles of grain size between 0.05 μm and 3.00 μm.

6. The composite tool component of claim 1, wherein the plurality of diamond particles include diamond particles of grain size between 2.0 μm and 60.0 μm.

7. The composite tool component of claim 1, wherein the plurality of graphene particles include 99 percent single layer graphene particles.

8. The composite tool component of claim 1, wherein the plurality of graphene particles include multiple layer graphene particles.

9. A polycrystalline diamond compact (PDC), comprising:

a substrate;

a polycrystalline diamond layer on one or more surface of the substrate, the polycrystalline diamond layer including:

a plurality of diamond particles;

a plurality of graphene particles located within the plurality of diamond particles; and a catalyst metal coating the diamond particles and the graphene particles, separately from each other, with a consistent thickness of continuous metal about both the diamond particles and the graphene particles to provide improved reaction and sintering between the plurality of diamond particles and the plurality of graphene particles as a result of more predictable reactions at contact points between particles.

10. The polycrystalline diamond compact of claim 9, wherein the substrate includes tungsten carbide.

11. The polycrystalline diamond compact of claim 9, wherein a bond between the polycrystalline diamond layer and the substrate includes a gradient of diffused cobalt from the substrate into the polycrystalline diamond layer.

12. A method of forming a composite tool, comprising:

coating a plurality of diamond particles with a catalyst metal to form coated diamond particles including a consistent thickness of continuous metal;

coating a plurality of graphene particles with the catalyst metal to form coated graphene particles including a consistent thickness of continuous metal;

mixing the coated diamond particles with the graphene particles, wherein mixing the coated diamond particles with coated graphene particles includes mixing the coated diamond particles with coated 3D graphene particles; and sintering the coated diamond particles and coated graphene particles to bind the coated diamond particles and coated graphene particles together, wherein the catalyst coating provides improved reaction and sintering between the coated diamond particles and the coated graphene particles as a result of more predictable reactions at contact points between particles.

13. The method of claim 12, further including leaching one or more outer surfaces of the composite tool after binding the coated diamond particles and coated graphene particles together.

14. The method of claim 12, wherein coating a plurality of diamond particles and a plurality of graphene particles includes coating from one or more precursor liquids.

* * * * *